US005663611A

United States Patent [19]

Seats et al.

[11] Patent Number: 5,663,611

[45] Date of Patent: Sep. 2, 1997

[54] PLASMA DISPLAY PANEL WITH FIELD EMITTERS

[75] Inventors: Peter Seats, Williamsburg, Va.; Neil Anthony Fox, Cheltenham, England

[73] Assignee: Smiths Industries Public Limited Company, London, England

[21] Appl. No.: 585,443

[22] Filed: Jan. 16, 1996

[30] Foreign Application Priority Data

Feb. 8, 1995 [GB] United Kingdom ..... 9502435

[51] Int. Cl.[6] ..... H01J 17/49

[52] U.S. Cl. ..... 313/584; 313/491; 313/495

[58] Field of Search ..... 313/491, 495, 313/496, 497, 584, 585, 586, 309, 336, 351

[56] References Cited

U.S. PATENT DOCUMENTS

| | | | |
|---|---|---|---|
| 3,743,879 | 7/1973 | Kupsky | 313/484 |
| 3,986,074 | 10/1976 | Watanabe et al. | 313/485 |
| 4,227,114 | 10/1980 | De Jule | 313/585 |
| 4,721,885 | 1/1988 | Brodie | 313/576 |
| 5,063,323 | 11/1991 | Longo et al. | 313/309 |
| 5,129,850 | 7/1992 | Kane et al. | 445/24 |
| 5,341,063 | 8/1994 | Kumar | 313/309 |
| 5,351,144 | 9/1994 | Tanamachi | 313/484 |
| 5,442,255 | 8/1995 | Ise et al. | 313/495 |
| 5,461,397 | 10/1995 | Zhang et al. | 345/66 |

FOREIGN PATENT DOCUMENTS

| | | | |
|---|---|---|---|
| 0 638 918 | 2/1995 | European Pat. Off. | H01J 1/00 |
| 44 09 832 | 10/1994 | Germany | H01J 17/49 |
| 485320 | 3/1970 | Switzerland | H01J 61/92 |
| 2235819 | 3/1991 | United Kingdom | H01J 31/12 |
| WO94/28571 | 12/1994 | WIPO | H01J 19/24 |

OTHER PUBLICATIONS

Liu, J., et al., "Modification of Si Field Emitter Surfaces by Chemical Conversion to SIC," *Journal of Vacuum Science & Technology B*, vol. 12, No. 2, Mar./Apr. 1994, pp. 717–721.

*Primary Examiner*—Michael Horabik
*Assistant Examiner*—Michael Day
*Attorney, Agent, or Firm*—Pollock, Vande, Sande & Priddy

[57] ABSTRACT

A multi-color display has a matrix of cells containing an ionizable gas and fluorescent layers (18) that fluoresce with different colors. The display has rows of cathodes (21) and anodes (20) one of each of which is exposed within each cell so that individual cells can be energized. Each cathode (21) has at least one field-emitter (23) which may be either an uncoated cone, a cone coated with a material with a negative electron affinity, such as a diamond film (27), or formed with a negative electron affinity material, such as diamond. Cells may include an aluminum layer (17) and a dielectric layer (16) for reflecting UV and VUV radiation.

17 Claims, 3 Drawing Sheets

PLASMA DISPLAY PANEL WITH FIELD EMITTERS

BACKGROUND OF THE INVENTION

This invention relates to displays such as of planar form.

Plasma display panels can give a high resolution, color display and be relatively compact. Present plasma display panels, however, are relatively inefficient, with luminous efficiencies being below 1 lm/W, which is considerably less than that of a CRT of about 4 lm/W. Also, plasma displays need high striking voltages, which can only be produced by expensive driver electronics.

Existing plasma displays operate in the following way. The high voltage between the cathode and anode produces a cathode fall region in from of the cathode through which plasma ions are accelerated towards the cathode. The ions impact the surface of the cathode and their energy is dissipated into heat and into the production of secondary electrons, the yield of which is proportional to the work function of the cathode metal. The secondary electrons drift through the gas plasma making ionizing collisions with the gas atoms and thereby sustaining the gas plasma. The secondary electrons also excite neutral atoms to resonance states, the gas mixture being chosen to contain gas species with resonant levels in the violet to ultra-violet (VUV) range of the spectrum so that, as the atoms fall back to their neutral state, they give up their energy as radiation in the VUV range. Phosphors in the display convert the VUV to visible light through the mechanism of photoluminescence.

The ion bombardment of the metal cathode needed to sustain a glow discharge does not generate secondary electrons efficiently. The yield from a typical low work function surface is less than 10%.

Furthermore, where secondary emission is used to generate charge carriers in a small cell, the number of carriers is depleted quickly because of high diffusion losses to the walls of the cell.

Proposals have also been made for planar displays incorporating a matrix of field emitters, such emitters being of the class of thin film structures incorporating microscopic points, edges or discontinuities, which give rise to room temperature free electron emission when a gate or electrode in close proximity is charged to a positive voltage, generally in the range of 10 to 100 V. The emitted electrons are then accelerated towards a phosphor layer, where they cause cathodoluminescence, the same light producing mechanism as in a CRT.

Phosphors, however, have a relatively low efficiency (about 1%) at low cathodoluminescent voltages, of about 400 volts, employed so far. Attempts to increase efficiency by increasing anode voltage to kilovolt levels have met with problems in fabricating displays capable of operating at these voltages.

BRIEF SUMMARY OF THE PRESENT INVENTION

It is an object of the present invention to provide an improved form of radiation-emitting display.

According to one aspect of the present invention there is provided a radiation-emitting display comprising a sealed assembly containing an ionizable gas, a fluorescent layer on a part of the assembly arranged to convert radiation emitted in the assembly to visible radiation, at least one first electrode arranged as an anode and at least one second electrode arranged as a cathode, the cathode having a field-emitting source that causes ionization of the gas in the assembly and the production of radiation.

The field-emitting source is preferably provided by a plurality of cones, which may be of silicon and may have a surface layer of diamond. The display may include a gate layer adjacent the field-emitting source. The gate layer may have a plurality of apertures, the display having a plurality of sources and the sources projecting into the apertures. Alternatively, the field-emitting source may be provided by a material with a negative electron affinity, such as diamond. The assembly preferably includes a plurality of cells, a cathode and anode being exposed within each cell such that gas can be ionized in each cell. The cells are preferably separated from one another by a plurality of walls and barriers extending orthogonal to the walls. The walls and barriers are preferably opaque to radiation so that radiation produced in one cell is substantially prevented from entering an adjacent cell. Different ones of the cells may have different fluorescent layers that fluoresce with different colors, such as red, green and blue. The assembly preferably has an upper plate and a lower plate, the cathode being formed on the lower plate, and the upper plate being transparent to visible radiation and reflective of UV and VUV radiation.

According to another aspect of the present invention there is provided a radiation-emitting display comprising: a sealed assembly with an upper plate transparent to visible radiation, a lower plate and a peripheral wall; an ionizable gas in the assembly; a plurality of internal walls opaque to radiation; a plurality of barriers opaque to radiation extending orthogonal to the internal walls so as to divide the assembly into a plurality of cells; a fluorescent layer on the internal walls and barriers to convert radiation emitted in the cells to visible radiation; at least one first electrode arranged as an anode in each cell; and at least one second electrode arranged as a cathode in each cell, the cathodes providing a field-emitting source in each cell arranged to cause ionization of the gas and the production of radiation, such that by energizing appropriate ones of the first and second electrodes, visible radiation can be produced in any one of the cells.

The or each cathode preferably extends along the lower plate and the or each anode preferably extends along the upper plate. The display may include a pair of ac electrodes, a cathode and a gate electrode, the gate electrode being located adjacent the cathode such that a voltage applied between the cathode and the gate electrode causes pre-ionization enabling a voltage between the ac electrodes to ignite a plasma. The ac electrodes are preferably on one plate and the cathode and gate electrodes are on the other plate. The assembly preferably has an internal pressure in the range 250–500 torr.

A display according to the present invention, will now be described, by way of example, with reference to the accompanying drawings.

DETAILED DESCRIPTION OF THE PREFERRED EMBODIMENTS

Figure 1:
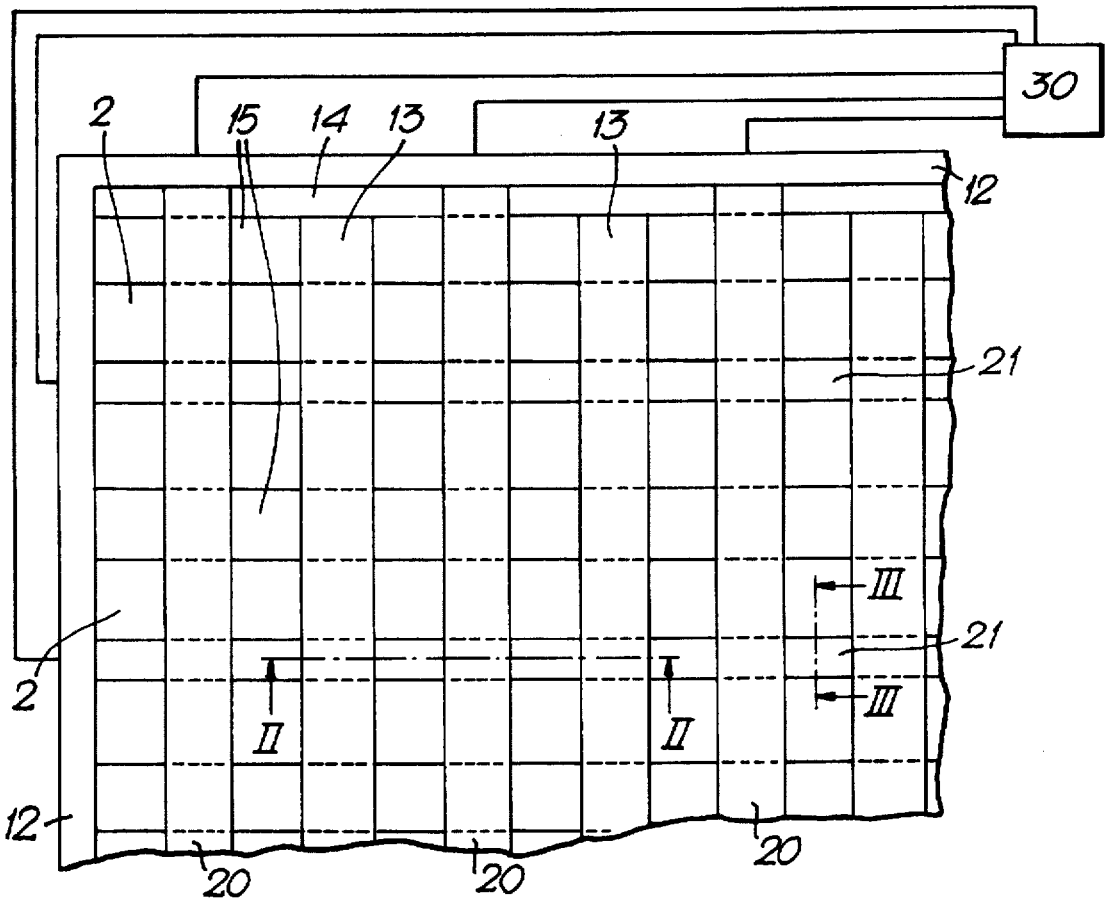
FIG. 1 is a plan view of a part of the display.
Figure 2:
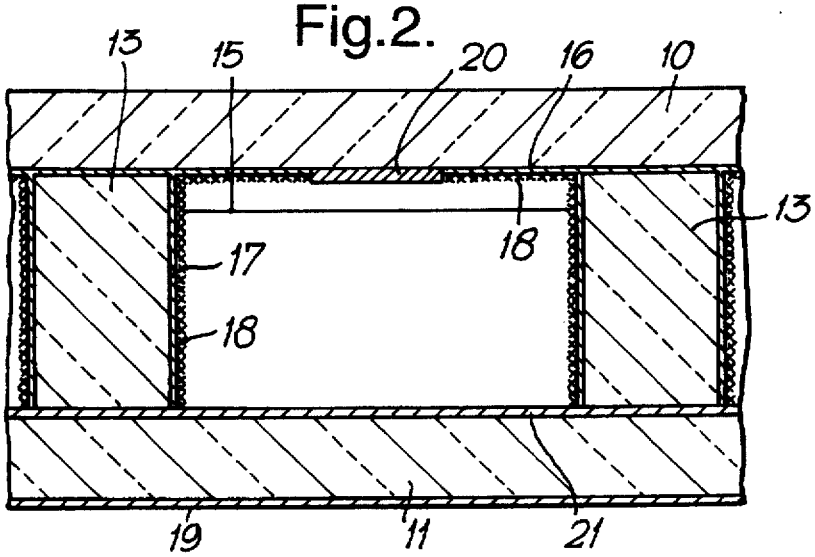
FIG. 2 is a sectional side elevation of the display along the line II—II, to a larger scale.
Figure 3:
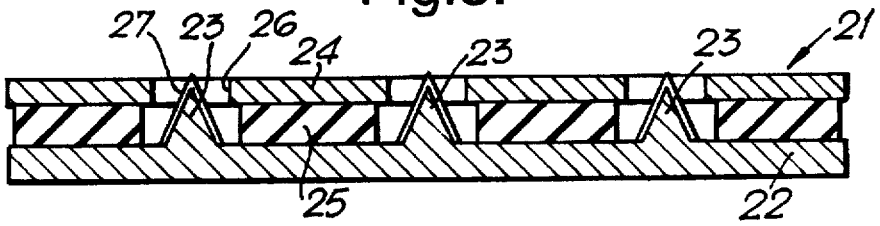
FIG. 3 is a sectional side elevation view of a field-emitter assembly of the display along the line III—III of FIG. 1.

With reference to FIGS. 1 to 3, the display has an upper plate 10 of a dielectric material, such as glass, which is transparent to light in the visible part of the spectrum. The plate 10 is about 1 mm thick. A lower plate 11, preferably made from the same material, or from a material with a similar thermal expansion, extends parallel to the upper plate 10. The upper plate 10 is supported above the lower plate 11 by peripheral walls 12, which may be formed by etching from the lower plate. The walls 12 are typically about 100 μm high but may be lower than this. The walls 12 are sealed to the underside of the upper plate 10 to form an enclosed assembly. Internally of the assembly, the upper plate 10 is supported by parallel walls 13 equally spaced from one another across the display to divide the display into parallel columns. The walls 13 do not extend completely across the display but are separated from the peripheral walls 12 along one side by a narrow channel 14 that enables gas communication between the different columns. The display is also divided into parallel rows by a number of parallel barriers 15, which extend orthogonally to the walls 13. The barriers 15 are lower than the walls 13 so that there is a small gap between the top of the barriers and the underside of the upper plate 10 (as shown in FIG. 2). This enables gas to flow along the columns of the display. The walls 13 and barriers 15 divide the cell into individual pixels or cells 2, each about 0.3 mm square.

The lower surface of the upper plate 10 is coated with a dielectric layer 16 that reflects radiation in the UV and VUV part of the spectrum but is transparent to visible light from blue through to red. The walls 13 and barriers 15 are preferably coated with an aluminum layer 17, which reflects radiation in the UV and visible part of the spectrum, so that radiation generated in one cell 2 is not transmitted to adjacent cells. The walls 13 and barriers 15 may be made opaque to radiation in other ways. On top of the layer 17 there is a fluorescent layer 18 of phosphor material. The fluorescent layer 18 is of one of three different phosphors that emit radiation in the red, blue or green parts of the spectrum, with cells 2 along each row and column being arranged: red, blue, green. The fluorescent layer 18 continues over the underside of the upper plate 10 and over the upper side of the lower plate 11 in the regions of the plates not occupied by the display electrodes 20 and 21.

The upper electrodes 20 are anodes and are provided by parallel conductive tracks extending centrally along the length of each column on the underside of the upper plate 10. Each anode track 20 is preferably formed by a layer of conductive material, such as tin oxide, indium tin oxide or aluminum, thin enough to be transparent to visible radiation.

The lower electrodes 21 are cathode tracks on the upper surface of the lower plate 11 extending orthogonally to the anode tracks 20, and are shown in greater detail in FIG. 3. Each cathode track is a thin film field-emitter comprising a strip 22 of silicon or metal, such as molybdenum, with a number of vertical cones 23. The cones are formed by deposition, etching, machining or any other technique, and are typically about 1–2 μm high. A conductive gate layer 24 is located adjacent the cones 23, being separated from the silicon layer 22 by an insulating layer 25. A gate layer is not always necessary, such as, when there is close spacing between the anode and cathode. The cones 23 project into and are exposed through apertures 26 in the gate layer 24; they may be left as uncoated molybdenum or coated with a second material to improve emissive or other properties, such as a semiconducting polycrystalline diamond film or an amorphic diamond film 27. The tips of the cones 23 function as microscopic formations for the emission of free electrons. The diamond film exhibits a negative electron affinity and a lower work function than the cone material, which increases the emissivity of the cones.

Figure 4:
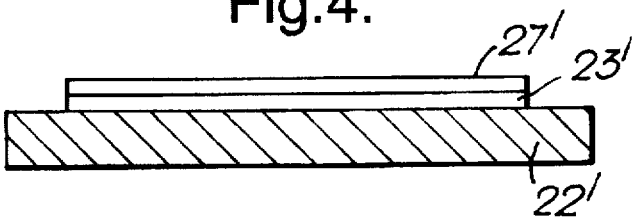
FIG. 4 is a sectional side elevation view of an alternative field-emitter assembly.

An alternative field emitting structure is shown in FIG. 4. In this structure, the substrate 22' is patterned with a metal electrode layer 23' and with a semiconducting diamond film layer 27'. The surface of the field emitter is smooth, the field-emitting property being achieved solely because of the field-emitting nature of the diamond material. Other materials with a negative electron affinity could be used. There is no gate layer.

The anode tracks 20 and cathode tracks 21 extend to a conventional address and drive unit 30. Because the anode and cathode tracks 20 and 21 are exposed within each cell, a voltage can be applied across any one of the cells 2 by energizing the appropriate combination of anode and cathode.

The display and its cells 2 are filled with an inert gas such as Xe or a mixture of gases such as Ar—Xe, Ne—Xe, Ne—Ar—Xe. Xe generates intense bursts of radiation of 157 nm (that is, in the VUV range) when excited in a gas discharge.

A relatively low voltage of between 30 and 100 V is applied across the selected cell 2, which operates as a Townsend discharge device. The field-emission matrix generates primary electrons, which excite the gas by collision in a weakly ionized plasma. Neutral atoms are then excited by the plasma particles to radiate VUV. The VUV photons impinge on the phosphor layer 18 causing it to fluoresce at visible wavelengths, either in the red, green or blue parts of the spectrum. The mechanism by which visible radiation is generated is, therefore, completely different from that of previous displays employing field-emitters where the energy of the electrons generated is used to produce cathodoluminescence by direct collision of the electrons with a phosphor layer.

The reflective layer 16 on the upper plate 10, and the aluminum layer 17 on the walls 13 and barriers 15 help confine the VUV radiation within the cell 2 so as to increase the probability of photoluminescent conversion in the phosphor layer 18. The lower surface of the lower plate 11 may also have a reflective layer 19 that reflects both VUV and visible radiation upwardly into the overlying cell 2. The cell configurations shown in the diagrams are not necessarily optimum for the highest coupling efficiency between the VUV radiation and the phosphor coating. Other configurations, which take advantage of the field emitter plasma initiation and structure within the cell cavity may be determined empirically to improve overall cell light conversion efficiency.

The display of the present invention requires only a low initiation voltage and, therefore, requires only low voltage driver circuits, which can be of lower cost, more compact, lighter and with lower heat dissipation than in conventional plasma displays. The display can use gas or gas mixtures optimized for a high UV output, such as including xenon. Because the display can operate at relatively high pressure (in the range 250–500 torr) compared with conventional discharge displays, this simplifies the construction of the display, in that it is not essential to provide a structure and seals capable of withstanding high vacuum. The efficiency of the display in converting electrical energy into visible energy can be very high. Also, there is no warm-up delay as in conventional cold cathode displays, so the display is essentially instantaneous, making it suitable for displaying rapidly changing images.

Figure 5:
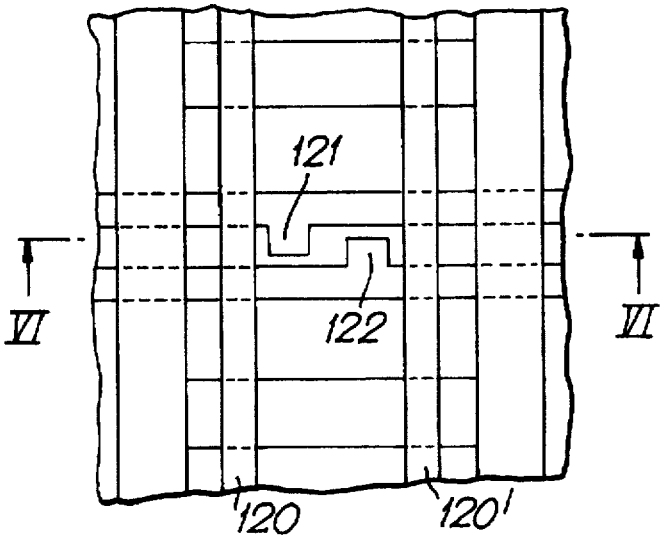
FIG. 5 is a plan view of a part of an alternative display.
Figure 6:
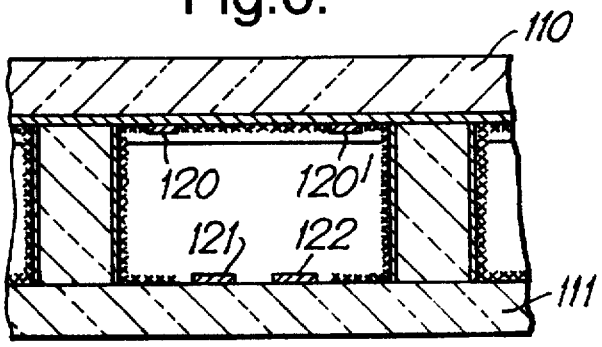
FIG. 6 is a sectional side elevation along the line VI—VI of FIG. 5.

Various alternative displays are possible, such as shown in FIGS. 5 and 6. In this display, the upper plate 110 has two electrodes 120 and 120', which are ac electrodes such that one is an anode while the other is a cathode. A field-emitter cathode 121 on the lower plate 111 is located adjacent a gate electrode 122. The gated field-emitter pre-ionizes the gas to enable the ac electrodes to ignite a plasma at a lower strike voltage than would otherwise be required. The ac electrodes could be driven at a voltage just below what is sufficient to strike a plasma, so that the plasma is produced when the field-emitter is energized. The gated field-emitter could also be used to sustain higher current densities in a plasma cell, for brighter pixels or grey scale.

Figure 7:
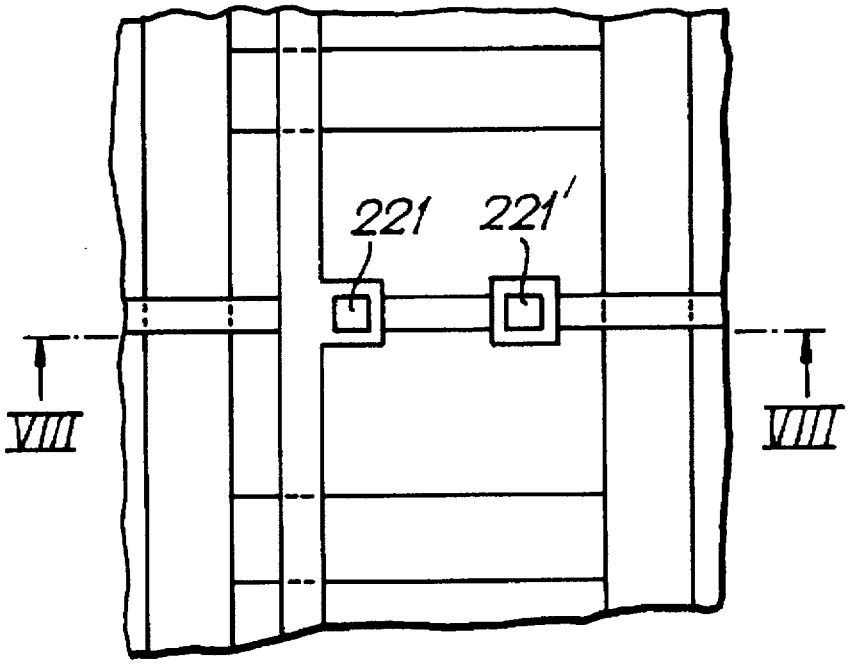
FIG. 7 is a plan view of another alternative display.
Figure 8:
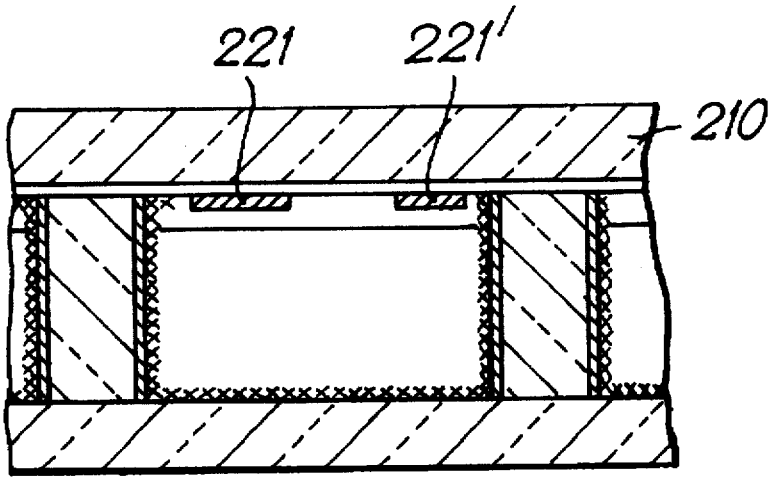
FIG. 8 is a sectional side elevation along the line VIII—VIII of FIG. 7.

In the arrangement of FIGS. 7 and 8, two field-emitter electrodes 221 and 221' are mounted on the upper plate 210 and are operated as ac electrodes such that one acts as an anode while the other acts as a field-emitter cathode.

What we claim is:

1. A radiation-emitting display comprising: a sealed assembly; an ionizable gas in said assembly; a fluorescent layer on a part of said assembly that converts radiation emitted in the assembly to visible radiation; at least one first electrode arranged as an anode; and at least one second electrode arranged as a cathode, wherein said cathode has a field-emitting source that generates electrons, and wherein the pressure of said gas within the assembly is such as to enable said electrons to ionize said gas and produce radiation that causes fluorescence of said layer, and to prevent cathodoluminescence of said layer.

2. A display according to claim 1, wherein said field-emitting source is a plurality of cones.

3. A display according to claim 2, wherein said cones have a surface of diamond.

4. A display according to claim 2, wherein said cones are of silicon.

5. A display according to claim 1, including a gate layer, said gate layer being located adjacent said field-emitting source.

6. A display according to claim 5, wherein said gate layer has a plurality of apertures, wherein said display has a plurality of field-emitting sources, and wherein said field-emitting sources project into said apertures.

7. A display according to claim 1, wherein said field-emitting source is a material with a negative electron affinity.

8. A display according to claim 7, wherein said material is diamond.

9. A display according to claim 1, wherein said assembly includes a plurality of cells, a plurality of walls and a plurality of barriers extending orthogonal to the walls separating said cells from one another, and wherein said cells open into one another.

10. A display according to claim 9, wherein said walls and barriers are opaque to radiation so that radiation produced in one of said cells is substantially prevented from entering an adjacent one of said cells.

11. A display according to claim 9, wherein said fluorescent layer in one of said cells is of a different material from the fluorescent layer in another of said cells such that different cells fluoresce with different colors.

12. A display according to claim 11, wherein said different colors are red, green and blue.

13. A display according to claim 1, wherein said assembly has an upper plate and a lower plate, wherein said cathode is formed on said lower plate, and wherein said upper plate is transparent to visible radiation and reflective of UV and VUV radiation.

14. A display according to claim 1, wherein said assembly has an internal pressure in a range 250–500 torr.

15. A radiation-emitting display comprising: a sealed assembly with an upper plate, a lower plate and a peripheral wall; an ionizable gas in said assembly; a plurality of internal walls, said internal walls being opaque to radiation; a plurality of barriers, said barriers being opaque to radiation and extending orthogonal to said internal walls so as to divide the assembly into a plurality of cells; a fluorescent layer on said internal walls and barriers to convert radiation emitted in said cells to visible radiation; at least one first electrode arranged as an anode in each said cell; and at least one second electrode arranged as a cathode in each said cell, wherein said cathode provides a field-emitting source in each cell that generates electrons, and wherein the pressure of said gas within each cell is such as to enable said electrons to ionize said gas and produce radiation that causes fluorescence of said layer, and to prevent cathodoluminescence of said layer such that by energizing appropriate ones of said first and second electrodes, visible radiation can be produced in any one of said cells.

16. A display according to claim 15, wherein said cathodes extend along said lower plate and said anodes extend along said upper plate.

17. A display according to claim 15, including a pair of ac electrodes, a cathode and a gate electrode, said gate electrode being located adjacent said cathode such that a voltage applied between said cathode and said gate electrode causes pro-ionization enabling a voltage between said ac electrodes to ignite a plasma.

* * * * *